United States Patent [19]

Herman

[11] 3,982,525

[45] Sept. 28, 1976

[54] HOT AIR FURNACE

[76] Inventor: John A. Herman, P.O. Box 125, St. Marys & First St., Suttons Bay, Mich. 49682

[22] Filed: Mar. 3, 1975

[21] Appl. No.: 554,507

[52] U.S. Cl. ..... 126/99 R; 126/116 R; 236/16

[51] Int. Cl.[2] ..... F24H 3/14

[58] Field of Search ..... 126/99 R, 110 R, 116 R, 126/110 B; 236/16, 10, 99 D

[56] References Cited

UNITED STATES PATENTS

| | | | |
|---|---|---|---|
| 1,001,656 | 8/1911 | Lininger et al. | 126/110 R |
| 1,014,347 | 1/1912 | Strand | 126/116 R |
| 1,715,007 | 5/1929 | Reuss | 126/110 R |
| 1,895,275 | 1/1933 | Brown | 236/16 |
| 2,523,412 | 9/1950 | Bauer | 126/116 R |
| 2,603,208 | 7/1952 | Beauchamp | 126/116 R |

*Primary Examiner*—William E. Wayner
*Assistant Examiner*—William E. Tapolcai, Jr.
*Attorney, Agent, or Firm*—Hugh L. Fisher

[57] ABSTRACT

A hot air furnace having a fire box and a plurality of heat exchange units connected together in series, the front wall of said furnace being common to said fire box and said heat exchange units and the remaining walls of said furnace being spaced from said fire box and wall, the furnace employing a mechanical draft control system which simultaneously regulates an air intake to the fire box and an air intake to the exhaust duct from the furnace to uniformly regulate the temperature in the furnace.

17 Claims, 9 Drawing Figures

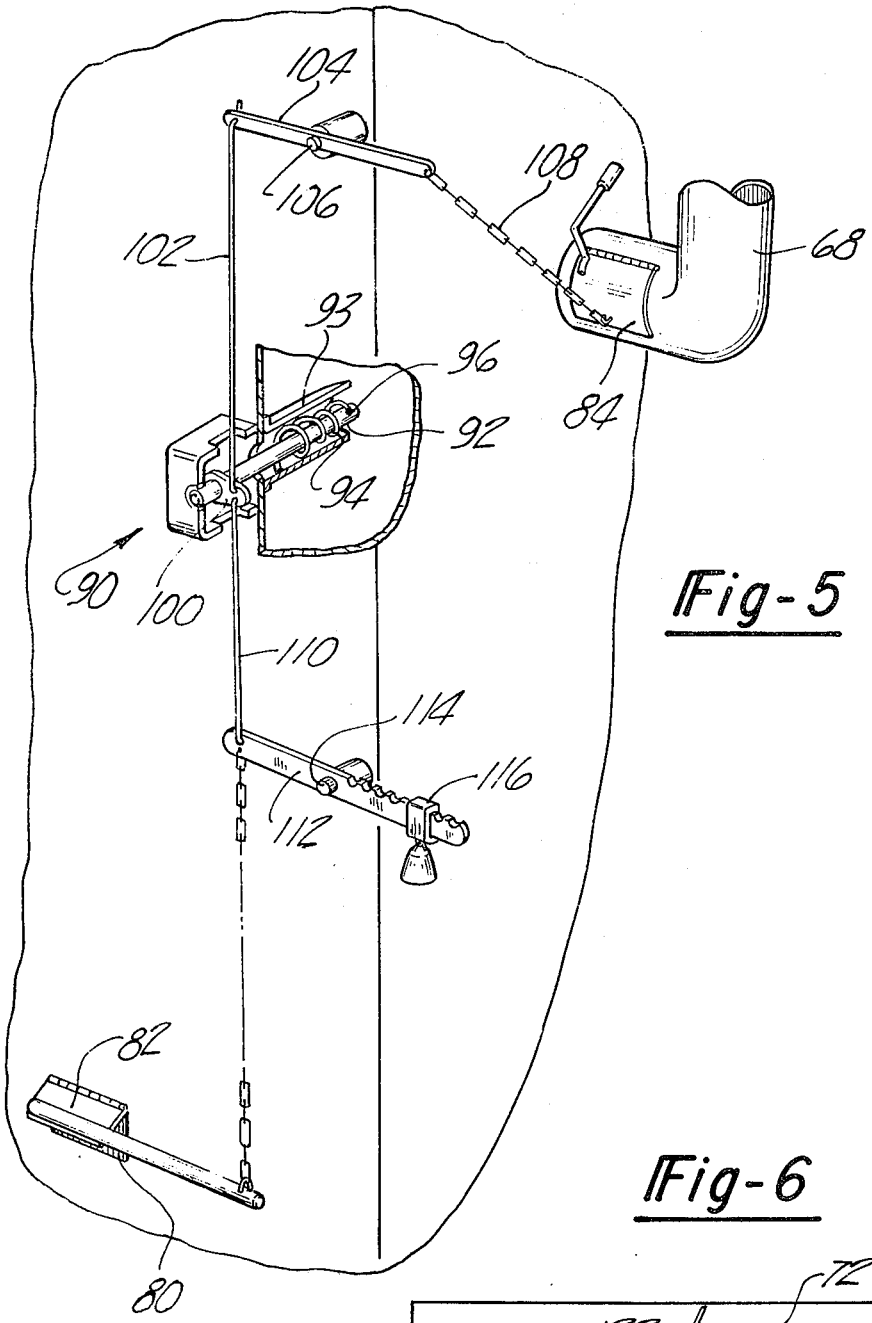
Fig-5
Fig-6
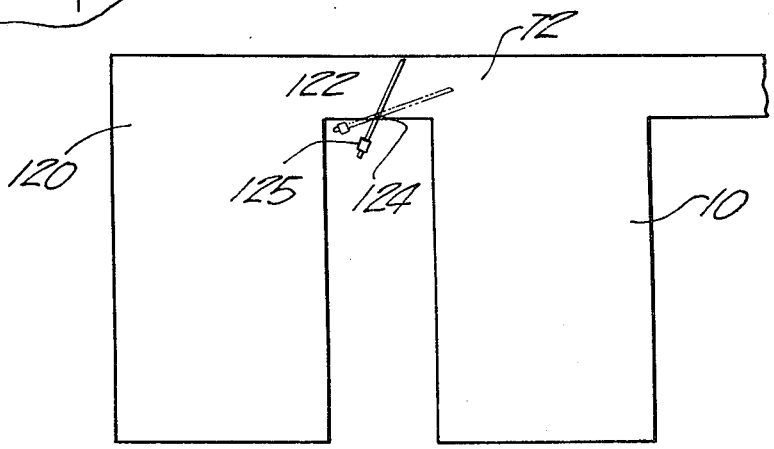

HOT AIR FURNACE

This invention relates to furnaces and more particularly to furnaces of the hot air type.

Hot air furnaces must frequently be used in localities where sources of electrical power are not readily available for utilizing electrical controls and blowers and as a result such furnaces are difficult to control to maintain a uniform temperature over relatively long periods of time. Such furnaces often are large and space consuming and present problems in their installation. Moreover, such furnaces often employ expensive cast iron components making for large, heavy and expensive installations.

It is an object of the invention to provide a hot air furnace which is compact and is arranged to transfer a majority of the heat from the products of combustion to the circulating cool air to be heated before the products of combustion are exhausted from the furnace.

It is another object of the invention to provide a hot air furnace which may be fabricated of readily available material such as sheet metal and bricks.

Another object of the invention is to provide a hot air furnace employing a plurality of heat exchange units for receiving the products of combustion which are connected together and compactly arranged within the furnace to present a maximum of heat transfer surfaces to the air circulating within the furnace to be heated.

Still another object of the invention is to provide a hot air furnace having a draft control system which does not require a power source and effectively responds to changes of temperature to regulate the furnace and maintain uniform temperatures over long periods of time.

A furnace of the hot air type is provided which may be constructed entirely of relatively light gauge sheet metal. The furnace may employ various types of fuel for combustion but in the preferred embodiment of the invention wood is used as a source of fuel. The furnace is so arranged that the products of combustion pass through a labryinth of heat exchange units before being discharged to an exhaust or smoke outlet and to a flue of a chimney. The components of the furnace are so arranged that cool air is circulated relative to a fire box and heat exchange units so that the heat from the hot products of combustion is transferred to the cool air to heat the latter and the heated air thereafter is delivered to areas to be heated. The heat exchange units are arranged in a particular manner so that maximum heat transfer areas are exposed to provide a very efficient transfer of heat from the products of combustion to the circulating air so that the products of combustion have transferred the majority of their heat prior to reaching the exhaust or smoke duct for discharge. The heat exchange units are so arranged that the products of combustion are obstructed in their passage from one heat exchange unit to another to permit the transfer from the heat exchange units to the air circulating in the furnace cavities surrounding the heat exchange units and to the hot air outlet. The furnace unit also includes a temperature responsive control assembly which does not require a source of electrical energy and responds mechanically to changes in temperature to regulate the combustion rate of the furnace and maintain a uniform heating capacity over relatively long periods of time.

FIG. 5 is a perspective view illustrating a draft control system for the furnace;

FIG. 6 is a schematic showing of the furnace embodying the invention used in conjunction with a second furnace;

Figure 1:
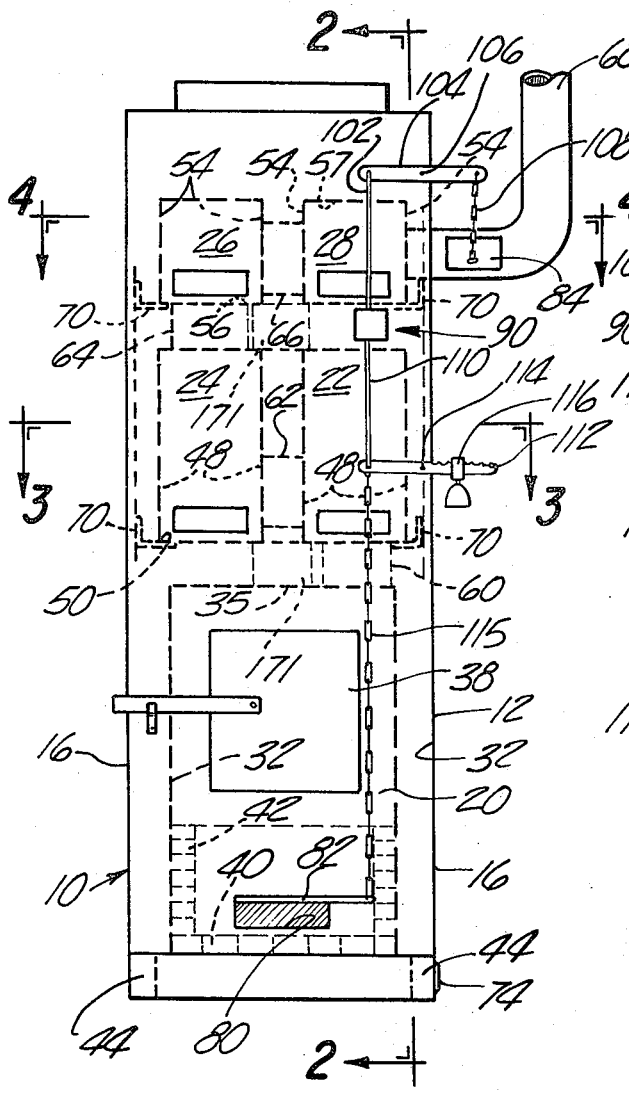
FIG. 1 is a sectional view of a hot air furnace embodying the invention.
Figure 2:
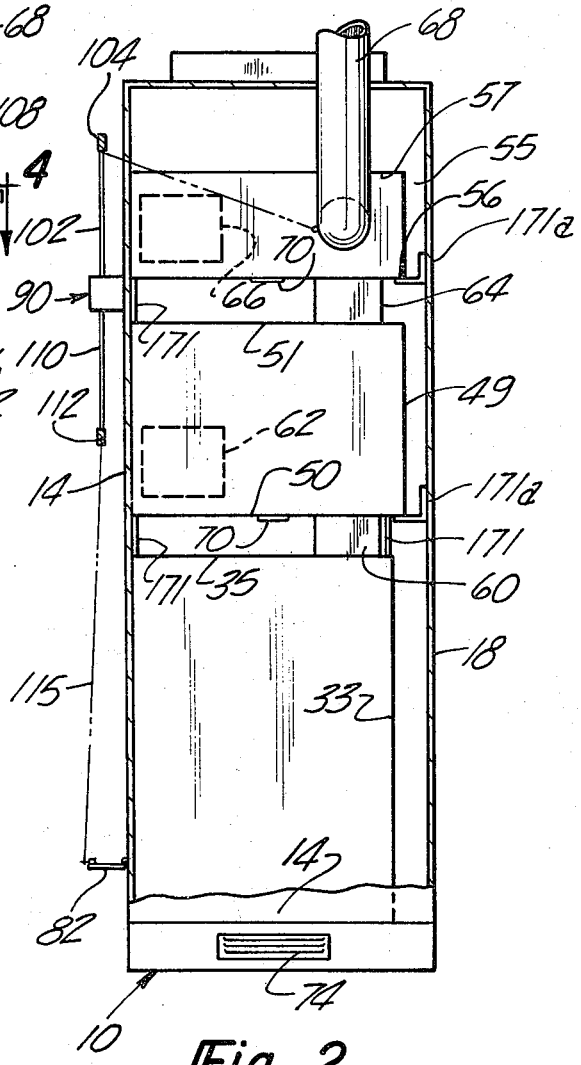
FIG. 2 is a sectional view taken generally on line 2—2 in FIG. 1.
Figure 3:
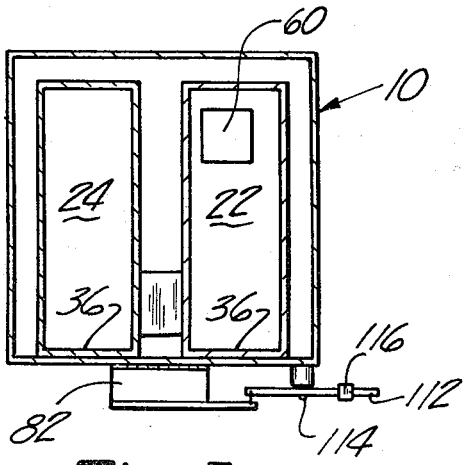
FIG. 3 is a sectional view taken generally on line 3—3 in FIG. 1.
Figure 4:
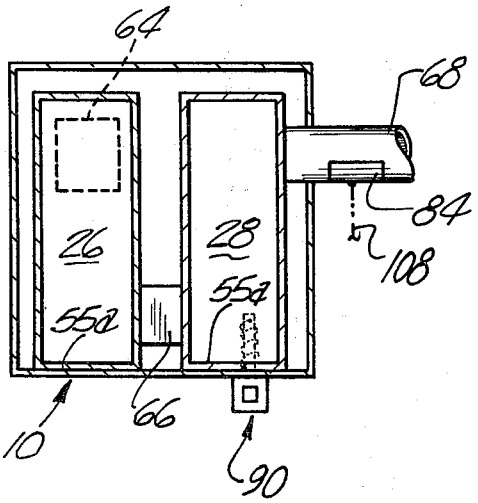
FIG. 4 is a sectional view taken generally on line 4—4 in FIG. 1.

Referring to the drawings and particularly FIGS. 1 and 2, the furnace embodying the invention is designated generally at 10. The furnace 10 includes a housing 12 which is generally rectangular and fabricated of flat pieces of sheet metal to form a front wall 14, spaced side walls 16 and a rear wall 18. Disposed within the housing 12 is a fire box 20 in which combustion takes place and a plurality of heat exchange units 22, 24, 26 and 28 to which the products of combustion are delivered to pass progressively through the heat exchange units for discharge through a smoke duct 30 adapted for connection to a chimney not shown.

The fire box 20 is of box like configuration and has side walls 32, a rear wall 33, a bottom portion 34, a top portion 35 and a front wall 36. The front wall 36 is bolted directly to the front wall 14 of the housing 12. An access door 38 is formed in the walls 36 and 14 through which fuel such as wood or coal may be deposited for combustion although other fuels such as oil or gas can be used. The floor or bottom portion 34 is lined with a layer of brick 40 and loose sand sufficient to fill any spaces between the bricks. Side walls also are formed of bricks 42 and form a lining extending upwardly for a portion of the lower areas of the fire box 20 leaving the upper areas exposed to easier transmission of heat. The bricks 40 and 42 provide a firepot in which solid fuels such as wood or coal may be burned or in which other fuels such as oil or gas may be used by the use of burners not shown.

The fire box 20 is disposed in the lower portion of the housing 12 and is supported by legs 44 relative to the supporting base such as the ground or floor to provide a space between the bottom or floor 34 of the fire box 20 for the circulation of air. As previously mentioned, the front wall 36 of the fire box 20 abuts the front wall 14 of the housing 12 but the side walls 32 and rear wall 34 are spaced from the side walls 16 of the housing 12 and the rear wall 18. In an actual embodiment of the invention in which the housing has a base dimension of approximately 24 inches by 24 inches, the fire box 20 was fabricated to have a base dimension of approximately 18 inches in width and 21 inches in depth so that a uniform spacing of approximately 3 inches is afforded at the sides and rear of the fire box 20 relative to the adjoining walls of the housing 12.

The heat exchange units 22, 24, 26 and 28 are disposed within the confines of the housing 12 and above the fire box 20. The heat exchange units 22 and 24 are similarly constructed of sheet metal to have parallel side walls 48 joined together by a rear wall 49 parallel to a front wall 49*a*, a lower wall 50 and a parallel spaced upper wall 51 which forms a box-like structure. The front walls 49*a* are fastened directly to the wall 14 of the housing 12.

The heat exchange units 26 and 28 also are generally box-like in configuration and are disposed in side-by-side relationship and above the heat exchange units 22 and 24. The heat exchange units 26 and 28 have parallel spaced side walls 54, a rear wall 55 parallel to the front wall 55*a*, a bottom wall 56 and a top wall 57. The front wall 55*a* abuts and is fastened to the wall 14.

As seen in FIG. 2, the fire box 20 communicates by means of a vertically extending duct 60 at the rear of the fire box 20 with an opening in the bottom wall 50 of the heat exchange unit 22 and at a point adjacent to the rear wall 49. The heat exchange unit 22 communicates with the heat exchange unit 24 by means of a duct 62 joining openings in adjacent side walls 48. The duct 62 is located adjacent to the front of the housing 12 and near its lower wall 50.

The heat exchange unit 24 communicates with the heat exchange unit 26 by means of a duct 64. The duct 64 joins an opening in the upper wall 51 of the heat exchange unit 24 and an opening in the bottom wall 56 of the heat exchange unit 26. The duct 64 is located adjacent the rear walls 49 and 55 of the heat exchange units 24 and 26 as best seen in FIG. 2.

The heat exchange units 26 and 28 are in communication with each other by means of a duct 66 communicating the heat exchange units 26 and 28 adjacent to their forward walls 55*a* abutting the front wall 14 of the housing 12.

The heat exchange unit 28 is connected to a smoke duct 68 which passes through a side wall 16 of the housing 12 and is adapted for connection to a chimney. The smoke duct 68 is connected to the heat exchange unit 28 at a point adjacent a rear wall 55 as best seen in FIG. 2.

The products of combustion generated in the fire box 20 pass progressively through the heat exchange units 22, 24, 26 and 28 by way of the ducts 60, 62, 64 and 66 which serve to connect the heat exchange units in series.

Preferably the fire box 20 as well as the heat exchange units 22, 24, 26 and 28 are fabricated of flat pieces of sheet metal of approximately 18 gauge material. The heat exchange units 22 and 24 are disposed in generally parallel spaced relationship to each other and each has one of its side walls 48 and its rear wall 49 spaced respectively of the side walls 16 and rear wall 18 of the housing 12. Preferably the spacing between the heat exchange units 22 and 24 is somewhat greater than the spacing between the heat exchange units and the housing walls 16 and 18. In an actual embodiment of the invention and by way of example only, the spacing between the heat exchange units was made to be approximately 3½ inches whereas the spacing between the heat exchange units and the walls of the housing were selected to be of approximately 2 inches. In a housing structure having a horizontal cross section of approximately 24 inches by 26 inches the width of the heat exchange units 22 and 24 can be to the order ot 8 inches.

The upper heat exchange units 26 and 28 are disposed in side-by-side relationship and are spaced apart approximately the same distance as the lower heat exchange units 22 and 24. The heat exchange units 26 and 28 also are spaced from the walls 16 and 18 of the housing 12 similarly to the heat exchange units in 22 and 24. In other words the spacing of the heat exchange units 26 and 28 from the walls of the housing is slightly less than the spacing of the heat exchange units from each other and from the lower heat exchange units 22 and 24.

The assembly of heat exchange units 22, 24, 26 and 28 and ducts 60, 62, 64 and 68 may be suspended and supported within the housing 14 by sheet metal brackets 70 fastened to the bottoms of the heat exchange units at a midpoint as by welding or the like and to the walls of the housing 14 by means of sheet metal screws. Rectangular brackets 171 may also be fastened as by welding to the front and back of the heat exchange units 22 and 24 to support them relative to the fire box 20 and to support the heat exchange units 26 and 28 relative to units 22 and 24. In addition angle brackets 171*a* may be used to support the rear of the heat exchange units relative to the rear wall 18 of the housing.

The upper end of the housing 12 is open and placed in communication with a heat conveying duct 72. The lower end of the housing 12 is provided with cold air ducts or openings 74 by which air is received within the housing 12 for circulation around the bottom and sides of the fire box 20 and upwardly around the heat exchange units 22, 24, 26 and 28 to be heated and transported through the heating duct 72 to the spaces requiring heat. It will be noted that the spacing of the side walls 32 and rear walls 33 of the fire box 20 from the side wall 16 and rear wall 18 of the housing 12 is greater than the spacing of the walls of the heat exchange units from the adjacent walls of the housing 12 as best seen in FIGS. 1 and 2. In an actual embodiment of the invention the fire box 20 was spaced approximately 3 inches from the housing walls whereas the heat exchange units were spaced approximately 2 inches. As a result, heat rising within the housing 12 from the cold air opening 74 is distributed sufficiently at an upper level of the fire box so that some of the rising air passes into the relatively narrow space adjacent the walls of the housing and a portion of the air is deflected into the relatively larger spacing between the fire box and heat exchange units 22 and 24 for passage upwardly between the upper and lower heat exchange units.

During use and with combustion taking place within the fire box 20, hot gases pass upwardly through the duct 60 to the rear end of the heat exchange unit 22. The hot gases are restricted in their passage from the heat exchange unit 22 to the heat exchange unit 24 because of the location of the duct 62 near a lower and forward end of the heat exchange unit 22. With such a duct location hot products of combustion are trapped within the upper levels of the heat exchange unit 22 until sufficient heat has been transferred from the hot flue gases to the air circulating around the heat exchange unit 22 so that the flue gases or products of combustion cool sufficiently to drop to the level of the duct 62.

The flue gases or products of combustion are received in the heat exchange unit 24 for transfer of heat to the air circulating around the outside of the heat exchange unit 24. The products of combustion are transported from the rear of the heat exchange unit 24 to the rear portion of the upper heat exchange unit 26 where they are temporarily restrained in their passage by the location of the duct 66 near a lower level of the heat exchange unit 26. Upon passage of the flue gases or products of combustion from the rear of the heat exchange unit 26 to the forward portion of the heat exchange unit 26 and through the duct 66 through the forward portion of the heat exchange unit 28 the gases or products of combustion pass to the rear of the heat exchange unit 28 and outwardly through the smoke duct 68. At the smoke duct 68, the products of combustion and gases being transported through the heat exchange units and in the various ducts will have transferred a sufficient amount of the heat from the products of combustion through the heat exchange units to the circulating air to warm the latter. At the same time the products of combustion have been cooled to a degree that the smoke duct 68 is relatively cool to the touch of the hand.

The furnace 10 embodies a draft control system which includes a draft or air intake opening 80 located in the front wall 14 of the housing 12 and near the bottom of the fire box 20. Through this passage air enters from the area surrounding the stove 10 to provide a draft for movement of the products of combustion and to support combustion within the fire box 20. The draft opening 80 is provided with a door 82 which is hinged for movement between open and closed positions relative to the draft opening 80.

The draft control system also includes an air intake opening 84 in the wall of the smoke duct 68. The opening 84 is provided with a hinged door 86 which forms a draft control member by which the opening 84 may be opened and closed.

As best seen in FIG. 5, the draft control system includes a control mechanism 90 which includes a shaft 92 rotatably disposed within a sleeve 93 fixed relative to a wall of the housing 12 so that opposite ends of the shaft 92 are disposed at opposite sides of the wall. Within the housing 12 and coaxial with the shaft 92 is a coil 94 of bimetallic material. One end of the coil is anchored at 96 to the shaft 92 and the opposite end of the coil 94 is anchored or fixed to the sleeve 93. The sleeve 93 may be cut away to expose the coil 94 so that in response to changes of temperature within the housing 12, coil 94 tends to uncoil or to coil tighter so that the shaft 92 is rotated in response to such temperature changes. The shaft 92 exterior of the housing 12 is provided with an arm 100 which tends to move with the shaft upon rotary motion of the latter in one direction or the other.

As seen in FIG. 5, the free end of the arm 100 may be connected by a member such as a rod 102 to one end of a lever 104 pivoted relative to the furnace 10 at a point 106. The opposite end of the lever 104 may be connected by means of a chain 108 to the draft control member 86 so that pivotal movement of the lever 104 moves the draft control member 86 between its closed position shown in FIG. 5 and an open position relative to the opening 84.

The arm 100 also is connected to a rod member 110 which depends downwardly and has it lower end operatively connected to one end of a lever 112 pivoted about a pin 114 relative to the housing 12. The free end of the lever 112 is provided with a weight 116 which may be moved longitudinally of the lever 112 to control the force required for the coil 94 and arm 100 to swing the lever 112 about its pivot 114. A chain 115 is connected to the lever 112 and has its lower end operatively connected to the door or draft control member 82 so that movement of the arm 100 and chain 115 serves to move the door or draft control member 82 between its open and closed positions.

In operation of the draft control arrangement shown In FIG. 5 and in a cold condition of the furnace 10, the lower draft control member 82 will be in its open position and the upper draft control member 86 will be in a closed position relative to its opening 84. The member 86 and opening 84 form what is known as a field draft control. When fuel is deposited in the fire box 20 and ignited, air will enter through the draft opening 80 to support the combustion and will pass upwardly through the heat exchange units 22 through 28. As air within the housing 12 is heated by the fire box 20 and the heat exchange units, the coil 94 of the control member 20 also is heated causing it to rotate the shaft 92 and swing the arm 100 so that the draft control member 82 is moved toward a closed position and simultaneously the draft control member 86 in the field draft control system is moved toward an open position. Opening of the field draft control 84, 86 permits air to be drawn from the areas surrounding the furnace 10 and to pass through the duct 68 to the chimney. Such passage of air creates a draft or movement of air from the fire box through the heat exchange units to the smoke duct 68.

As the circulating air increases to a desirable temperature level, the arm 100 swings to move the draft control member 82 towards its closed position and to open the field control member 82 to a more open position. This tends to diminish the rate of combustion. As changes of temperature increase, the control member 90 moves the draft control members 82 and 86 to maintain a desired level of combustion and heat. Such a level can be adjusted by moving the weight 116 inwardly on the arm 112 to increase the responsiveness of the control member 90 or outwardly toward the free end of the arm 112 to slow the response of the draft control system.

During operation of the furnace 10, air within the housing 12 is effectively heated by the flue gases passing through the chambers of the heat exchange units 22, 24, 26 and 28. In some installations it may be desirable to dispense with the heat exchange unit 28 in which case the exhaust duct 68 would be connected to the heat exchange unit 26 or if only units 22 and 24 were to be used, the exhaust duct 68 would be connected to the heat exchange unit 24. In all such installations, the exhaust duct 68 is provided with a field draft control 84 for regulation by the control mechanism 90.

Referring now to FIG. 6, it may sometimes be desirable to use the furnace 10 of the present invention in connection or in combination with a second furnace. For example, in some installations, the second furnace 120 may be an oil or gas fired unit which is ignited automatically upon manual control by means of a pilot light. The other furnace 10 may be of the type embodying the present invention and may utilize solid fuels such as wood or coal. In such installations it is usual to use only one or other of the furnaces 10 or 120 at any one time. In such an installation and with the furnaces 10 and 120 in side-by-side relationship, the hot air duct 72 may communicate the upper ends of both of the furnaces 10 and 120. At a point intermediate the two furnaces, the heating duct 72 is provided with a damper 122 which pivots about an axis indicated at 124 and is balanced by a weight 125 to move between the closed position shown in full lines in FIG. 6 to an open position. When the furnace 120 is in operation, heated air passes to the upper end of the furnace 120 and the moving air serves to move the damper 122 to its open position so that the heated air is free to pass in the heating duct 72. When the oil furnace 120 is not in use or when the furnace 10 is being utilized to burn solid fuel, the damper 122 is moved to its closed position due in part to the counter weight indicated at 125 and the lack of air moving from the furnace 120 so that the heat duct 72 between the furnaces 10 and 120 is closed. This prevents heated air from passing from the furnace 10 through the heat duct 72 to the furnace 120 to extinguish the pilot flame which is usually left burning in readiness to ignite the burner forming part of the furnace 120.

Figure 7:
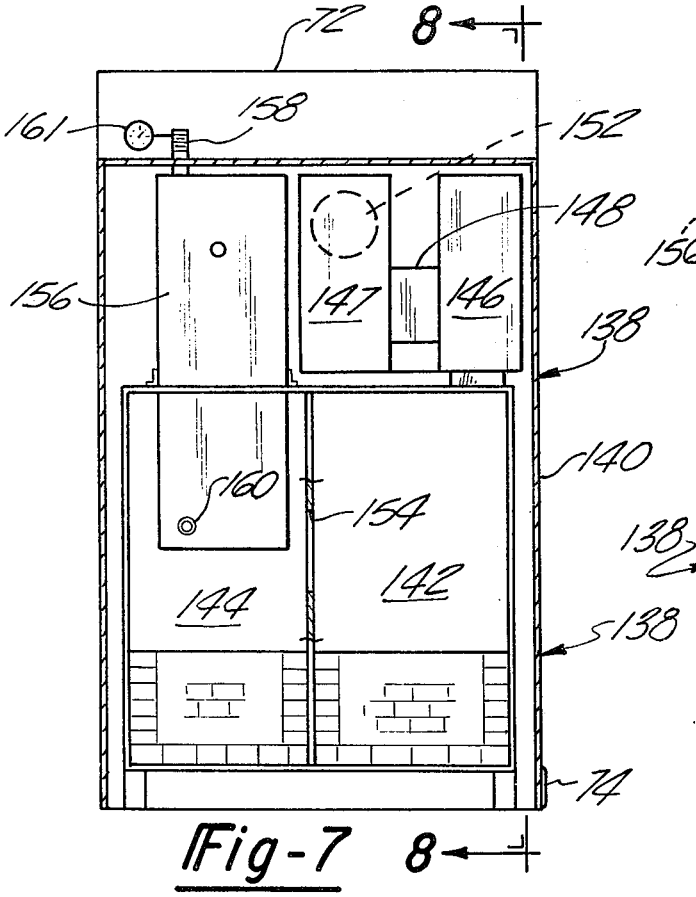
FIG. 7 is a sectional view showing a modified form of the invention.
Figure 8:
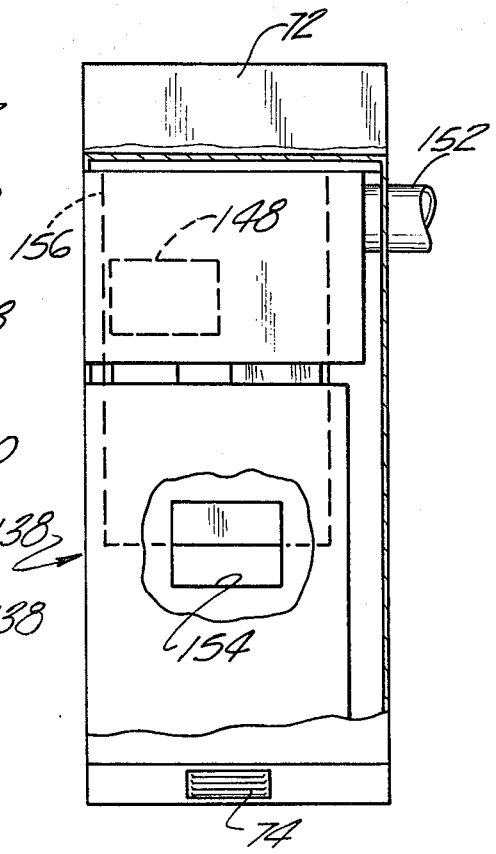
FIG. 8 is a sectional view taken generally on line 8—8 in FIG. 7.

Referring now to FIG. 7, a modification of the furnace 10 is illustrated. In this instance the furnace is indicated at 138 and includes a housing 140 within which a fire box 142 and 144 are disposed in side-by-side relationship at a lower portion of the housing. The fire box 143 directs its hot products of combustion to a heat exchange unit 146 in a manner similar to the fire box 20 and heat exchange unit 22 in the furnace 10. The hot products of combustion pass from the heat exchange unit 146 to a second heat exchange unit 147 through a duct 148 which compare generally and respectively to the heat exchange units 22, 24 and the duct 62 in the furnace 10. In the modified form of the invention however, the heat exchange unit 147 has its rear portion connected to a smoke duct 152. The fire box 142 is of similar configuration to the fire box 140 and is formed with an exhaust duct 154 which places the combustion area of the fire boxes 142 and 144 in communication with each other.

A hot water tank 156 is disposed within the housing 140 so that a lower portion projects downwardly and is disposed within the fire box 144. The cold water tank 156 is provided with a cold water inlet 160 by which water may be introduced into the tank 156. The upper part of the tank 156 may be provided with a hot water outlet 158 by which heated water may be withdrawn from the tank. Also a water temperature gauge as indicated at 161 may be used.

Figure 9:
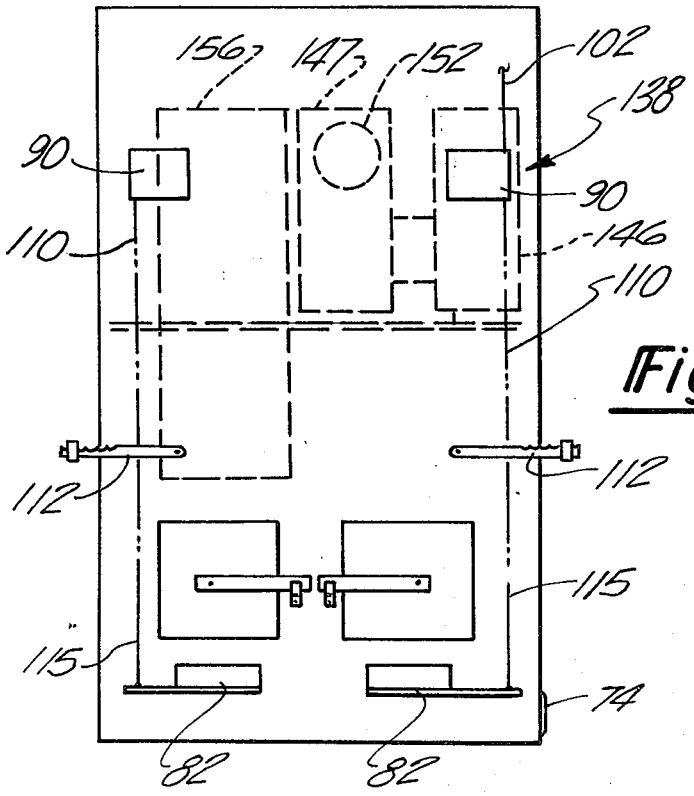
FIG. 9 is a plan view of the furnace shown in FIG. 7 and showing the disposition of a draft control arrangement.

In the modified form of the furnace 138 the control mechanism 90 shown in FIG. 5, may be disposed so that the shaft 92 and bimetal coil 94 are within the hot water tank 156. As best seen in FIG. 9, changes in water temperature in tank 156 are effective to actuate the control assembly 90 to move the associated arm 112 and the draft control door 82 so that as the temperature of the water increases the draft control door 82 is moved toward a closed position. A separate draft control mechanism 90 may be associated with the fire box 142 and its draft control member 82 and a field draft control arrangement associated with the exhaust duct 152 and not shown in FIG. 9 but similar to the field draft control arrangement 86 seen in FIG. 5.

The modified form of the furnace 138 may be used in the same manner as the furnace 10 by burning fuel in the fire box 142 so that cold return or room air is circulated around the fire boxes 142 and 144 and upwardly around the upper portion of the hot water tank 156 and heat exchangers 146 and 147 after which the heated air is delivered to the heat duct 72. When desired, fuel may also be burned in the fire box 144. In that case the hot burning fuel serves to directly transmit heat to the bottom of the water tank 156 and the products of combustion pass through the duct 154 to the fire box 142.

The fire box 144 may be employed alone to heat the water tank 156 and the products of combustion will pass into the fire box 142 and upwardly through the heat exchange units and to the smoke outlet 152. When only the fire box 144 is employed, the heat of combustion is used principally for heating the water and the by products of combustion pass in series through the fire box 142 and heat exchange units 146 to heat the circulating air which is conveyed to the area to be heated. In such an instance, only moderate heat is transmitted to the areas to be heated and if additional heat is required fuel can be burned in the fire box 142 to supplement the burning of fuel in the fire box 144.

The embodiments of the invention in which an exclusive property or privilege is claimed are defined as follows:

1. In a hot air furnace, the combination of; a rectilinear housing having an exhaust outlet, a firebox disposed in said housing, a plurality of heat exchange members forming elongated chambers within said housing and above said firebox, passage means communicating said chambers in series, one chamber at one end of said series of chambers being connected to said firebox to receive products of combustion therefrom and a chamber at the other end of said series of chambers being connected to said exhaust outlet to discharge products of combustion therefrom, one wall of said housing and one wall of each of said chambers being in common with each other, the remaining walls of said chambers being spaced from each other and from the walls of said housing to permit the passage of air, said housing having an air inlet adjacent the bottom of said housing for receiving relatively cool air, and an air outlet adjacent the top of said housing for discharging warm air passing around said heat exchange members.

2. The combination of claim 1 in which said fire box has a forward wall common to one wall of said housing and having its remaining walls spaced from said housing and said heat exchange members.

3. The combination of claim 2 in which the spacing of said fire box from the walls of said housing is greater than the spacing of said heat exchange members from the walls of said housing.

4. The combination of claim 1 in which said heat exchange members are elongated and in which said passage means connect a first one of said heat exchange members adjacent one of its ends to said fire box and connects the other end of said first one of said heat exchange members to an adjacent end of the next of said heat exchange members in said series, a second one of said heat exchange members at the other end of said series of chambers being connected adjacent one of its ends to said exhaust outlet and adjacent the other of its ends to the adjacent end of an adjacent one of said heat exchange members in said series.

5. The combination of claim 1 in which said plurality of heat exchange members includes a pair of heat exchange members disposed in horizontally and spaced relationship to each other.

6. The combination of claim 5 and further comprising a second pair of heat exchange members disposed in horizontally spaced relationship to each other and in vertically spaced relationship above said first pair of heat exchange members.

7. The combination of claim 6 in which each of said heat exchange members form spaced upper and lower wall portions, said passage means communicating said first pair of heat exchange members to each other at a location closer to said lower wall than to said upper wall, said passage means connecting said second pair of heat exchange members to each other at a location closer to said lower wall than to said upper wall.

8. The combination of claim 6 in which the spacing of said first and second pairs of heat exchange members from said other walls of said housing is less than the spacing of said chambers from each other and from said fire box.

9. The combination of claim 5, in which said pair of heat exchange members are disposed in uniformly spaced relationship to each other and in which the spacing is greater than the spacing of said heat exchange members from the walls of said housing.

10. A combination of claim 1 and further comprising a second fire box disposed in said housing, duct means communicating said second fire box to said first mentioned fire box, and a water tank having a portion disposed in said second fire box to be heated thereby.

11. The combination of claim 1 in which said heat exchange members are elongated, box-like structures disposed in horizontally spaced relationship to each other.

12. The combination of claim 11 in which each of said heat exchange members includes side walls parallel to each other, to the walls in the adjacent heat exchange member and to the walls of said housing.

13. The combination of claim 12 in which said passage means connect adjoining side walls of said heat exchange members at one end thereof and at a point in said side walls closer to the bottom than to the top of said heat exchange members.

14. The combination of claim 13 and further comprising a second pair of heat exchange members disposed in horizontally spaced relationship to said first pair of heat exchange members.

15. The combination of claim 14 in which said passage means communicate one heat exchange member of said first pair of heat exchange members to one heat exchange member of said second pair of heat exchange members adjacent an end of said one heat exchange member of each pair.

16. The combination of claim 1 in which draft member is movable to open and close said air inlet, said exhaust outlet having an air intake opening, a closure member movable to open and close said intake opening, and control means to move said draft member from an open to a closed position relative to said air inlet and simultaneously move said closure member from a closed to an open position relative to said air intake opening, said control means including a shaft, a temperature responsive bimetal element coiled about said shaft, said bimetal element having one end connected to said shaft and the other end fixed relative to said housing whereupon changes in temperature rotates said shaft, connecting means operatively connected to said draft member and closure member and including an arm member movable in response to movement of said shaft, and a weight member on said arm member movable longitudinally thereof to vary the response of rotation of said shaft for any given temperature.

17. In a hot air furnace, the combination of; a housing, a firebox in said housing, an air inlet formed in said firebox, a damper member movable between positions opening and closing said air inlet, an exhaust member communicating with said housing and with said firebox, said exhaust member forming an air intake opening, a closure member movable between open and closed positions relative to said intake opening, control means movable in response to changes in temperature in said housing and being operatively connected to said damper member to move the latter from an open towards a closed position upon an increase in temperature in said housing and to simultaneously move the latter from a closed toward an open position, said control means including a shaft rotatably mounted in said housing, a bimetal element coiled about said shaft and being responsive to changes in temperature to coil and uncoil, said bimetal element having one end connected to said shaft and the other end fixed relative to said housing whereupon changes in temperature in said housing rotates said shaft, means operatively connecting said damper member and said closure member to move the latter upon rotation upon said shaft, an arm member movable in response to movement of said shaft, and a weight member on said arm movable longitudinally thereof to vary the response of rotation of said shaft for any given temperature.

* * * * *

UNITED STATES PATENT OFFICE

CERTIFICATE OF CORRECTION

Patent No. 3,982,525 Dated September 28, 1976

Inventor(s) John A. Herman

It is certified that error appears in the above-identified patent and that said Letters Patent are hereby corrected as shown below:

Column 2, line 45, "to" should read --for--.

Column 3, line 64, "ot" should read --of--.

Column 7, line 21, "143" should read --142--.

Column 8, line 59, "and" should be deleted.

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*